US010392894B2

(12) United States Patent
Kibler et al.

(10) Patent No.: US 10,392,894 B2
(45) Date of Patent: Aug. 27, 2019

(54) REMOTELY OPERATED BALL DROP AND NIGHT CAP REMOVAL DEVICE FOR WELLHEAD PRESSURE CONTROL APPARATUS

(71) Applicant: FHE USA LLC, Fruita, CO (US)

(72) Inventors: Matthew Kibler, Grand Junction, CO (US); Kyle Scholl, Dunlap, IL (US); Nicolas G. Snoke, Grand Junction, CO (US); Randy Cassady, Spring Branch, TX (US)

(73) Assignee: FHE USA LLC, Fruita, CO (US)

( * ) Notice: Subject to any disclaimer, the term of this patent is extended or adjusted under 35 U.S.C. 154(b) by 0 days.

(21) Appl. No.: 16/198,196

(22) Filed: Nov. 21, 2018

(65) Prior Publication Data

US 2019/0153804 A1 May 23, 2019

Related U.S. Application Data

(60) Provisional application No. 62/589,719, filed on Nov. 22, 2017.

(51) Int. Cl.
*E21B 33/03* (2006.01)
*E21B 33/068* (2006.01)

(52) U.S. Cl.
CPC ..... *E21B 33/068* (2013.01); *E21B 33/03* (2013.01)

(58) Field of Classification Search
CPC ..... E21B 33/068; E21B 33/03
See application file for complete search history.

(56) References Cited

U.S. PATENT DOCUMENTS

| | | | | |
|---|---|---|---|---|
| 7,219,740 | B2 * | 5/2007 | Saucier | E21B 33/035 166/344 |
| 9,644,443 | B1 * | 5/2017 | Johansen | E21B 33/03 |
| 9,670,745 | B1 * | 6/2017 | Johansen | E21B 33/03 |
| 9,879,496 | B2 * | 1/2018 | Johansen | E21B 33/03 |
| 9,976,362 | B2 * | 5/2018 | Rahim | E21B 33/02 |
| 10,030,461 | B2 * | 7/2018 | Johansen | E21B 33/03 |
| 10,072,474 | B2 * | 9/2018 | Johansen | E21B 33/03 |
| 2003/0178200 | A1 | 9/2003 | Fox et al. | |

(Continued)

OTHER PUBLICATIONS

International Search Report and Written Opinion, International Application No. PCT/US2018/062170.

*Primary Examiner* — Nicole Coy
(74) *Attorney, Agent, or Firm* — Richard A. Fagin

(57) ABSTRACT

A method for conducting well intervention operations includes disposing a combination well intervention apparatus proximate a pressure control apparatus coupled to the wellbore. The apparatus has a pressure control device adapter and at least one other type of well intervention device coupled to the adapter such that either the adapter or the at least one other apparatus is disposed over the pressure control apparatus. The method includes at least one of, (i) locking the adapter in the pressure control apparatus by operating a remotely operable locking device on the pressure control apparatus or (ii) disposing the other type of well intervention device over the pressure control apparatus. The method includes locking the adapter in the pressure control apparatus when the adapter is disposed over the pressure control apparatus, or operating the at least one other type of well intervention device when disposed over the pressure control apparatus.

13 Claims, 10 Drawing Sheets

(56) References Cited

U.S. PATENT DOCUMENTS

| | | | | |
|---|---|---|---|---|
| 2005/0217844 | A1 | 10/2005 | Edwards et al. | |
| 2010/0025044 | A1 | 2/2010 | McKay et al. | |
| 2011/0240303 | A1* | 10/2011 | Hallundbaek | B63C 11/42 166/339 |
| 2013/0153237 | A1 | 6/2013 | McGuire | |
| 2013/0206419 | A1* | 8/2013 | Hallundbaek | E21B 33/06 166/341 |
| 2014/0124686 | A1 | 5/2014 | Hallundbaek et al. | |

* cited by examiner

REMOTELY OPERATED BALL DROP AND NIGHT CAP REMOVAL DEVICE FOR WELLHEAD PRESSURE CONTROL APPARATUS

CROSS REFERENCE TO RELATED APPLICATIONS

Priority is claimed from U.S. Provisional Application No. 62/589,719 filed on Nov. 22, 2017 and incorporated herein by reference

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

This disclosure relates to the field of pressure control systems used in connection with wellbores drilled through subsurface formations. More particularly, the disclosure relates to apparatus used with well pressure control systems that enables multiple well intervention operations to be performed without the need to move personnel close to the well pressure control system.

U.S. Pat. Nos. 9,670,745 and 9,644,443 issued to Johansen et al. disclose various example embodiments of a wellhead pressure control apparatus. Disclosed embodiments include a cam lock design with a secondary lock, in which the pressure control apparatus replaces connections done conventionally either by hammering, torqueing, or with a quick union nut, all of which require the interaction of a human operator to perform these operations. The disclosed embodiments include a wellhead pressure control fitting comprising a generally tubular Pressure Control Equipment (PCE) adapter having first and second adapter ends wherein the first adapter end is configured to mate with pressure control equipment.

In some embodiments disclosed in the foregoing patents, the second adapter end provides an annular first adapter rib, a generally tubular pressure control assembly having first and second assembly ends and a longitudinal centerline, the centerline defining axial displacement parallel to the centerline and radial displacement perpendicular to the centerline. The first assembly end providing a first assembly end interior, the second assembly end configured to mate with a wellhead, the first assembly end interior providing a PCE receptacle for receiving the second adapter end, the second adapter end and the PCE receptacle further each providing cooperating abutment surfaces, the cooperating abutment surfaces forming a pressure seal between the second adapter end and the PCE receptacle when the second adapter end is compressively received into the PCE receptacle, the first assembly end interior further providing a lower wedge assembly, the lower wedge assembly including a plurality of lower wedges, each lower wedge having first and second opposing lower wedge sides, each first lower wedge side providing protruding top and bottom lower wedge ribs, a generally hollow lower wedge receptacle, the lower wedge receptacle further providing a plurality of shaped lower wedge receptacle recesses formed in an interior thereof, one lower wedge receptacle recess for each lower wedge, the lower wedge receptacle further having first and second opposing lower wedge receptacle sides in which the lower wedge receptacle recesses define the first lower wedge receptacle side, and wherein each lower wedge is received into a corresponding lower wedge receptacle recess so that the first lower wedge receptacle side and the second lower wedge sides provide opposing sloped lower wedge surfaces, wherein axial displacement of the lower wedge receptacle relative to the lower wedges causes corresponding radial displacement of the lower wedges, and wherein, as the second adapter end enters the PCE receptacle and engages the cooperating abutment surfaces, axial displacement of the lower wedge receptacle relative to the lower wedges c In such embodiments as disclosed in the foregoing referenced patents, a crane operator may place pressure control equipment (PCE) directly onto the wellhead using the pressure control apparatus's highly visible entry guide. The crane operator may then proceed to actuate the pressure control apparatus and secure the pressure control equipment in embodiments where the crane is equipped with the apparatus's remote controls. In some embodiments, a second operator may operate the pressure control apparatus remotely while the crane holds the pressure control equipment in the entry guide.

Embodiments of the pressure control apparatus disclosed in the foregoing patents also provide a "night cap" option to cap the well if there will be multiple operations. Consistent with conventional practice in the field, the apparatus includes a night cap option, available separately, for sealing off the wellhead while the PCE has been temporarily removed, such as at the end of the day. Embodiments including the night cap enable the apparatus to remain connected to the wellhead, and wellhead pressure to be retained, in periods when PCE is temporarily removed.

In some well operations, one or more balls may be dropped to actuate devices within the wellbore, for example, fracture zone isolation seals.

SUMMARY

A method for conducting intervention operations on a wellbore according to one aspect of the present disclosure includes disposing a combination well intervention apparatus proximate a pressure control apparatus coupled to the wellbore. The combination apparatus comprises at least a pressure control device adapter and at least one other type of well intervention device coupled to the adapter such that either the pressure control device adapter or the at least one other type of well intervention apparatus is disposed over the pressure control apparatus. The method further includes at least one of, (i) locking the pressure control device adapter in the pressure control apparatus by operating a remotely operable locking device on the pressure control apparatus or (ii) disposing the at least one other type of well intervention device over the pressure control apparatus. The pressure control device adapter is locked in the pressure control apparatus when the pressure control device adapter is disposed over the pressure control apparatus, or operating the at least one other type of well intervention device when disposed over the pressure control apparatus.

Some embodiments further comprise moving the other of the at least one other type of well intervention device or the well pressure control adapter over the pressure control apparatus and operating the at least one other type of well intervention device when disposed over the pressure control apparatus or locking the pressure control device adapter in the pressure control apparatus when the pressure control device adapter is disposed over the pressure control device.

In some embodiments, the at least one other type of well intervention device comprises a remotely operable ball drop apparatus.

In some embodiments, the at least one other type of well intervention device comprises a pressure tight cap insertable into the pressure control apparatus.

Some embodiments further comprise at least two of another type of well intervention device coupled to the pressure control device adapter.

In some embodiments, the at least two of another type of well intervention device comprises one remotely operable ball drop apparatus and one pressure tight cap insertable into the pressure control apparatus.

In some embodiments, the at least two of another type of well intervention device comprises two remotely operable ball drop apparatus.

An apparatus for use with a remotely operable pressure control apparatus according to another aspect of the present disclosure comprises a pressure control device adapter having features thereon for releasably locking the pressure control device adapter to the pressure control apparatus and at least a first well intervention apparatus and a second well intervention apparatus connected to the pressure control device adapter such that a selected one of the first well intervention apparatus, the second well intervention apparatus and the adapter is movable over the pressure control apparatus.

In some embodiments, the first well intervention apparatus and the second well intervention apparatus each comprise one of a first remotely operable ball drop apparatus and a night cap having a remotely operable latch connected to the pressure control device adapter laterally spaced apart therefrom such that the pressure control device adapter and the at least one of a remotely operable ball drop apparatus and a night cap having a remotely operable latch are selectively movable over an upper opening in the pressure control apparatus.

Some embodiments further comprise a second remotely operable ball drop apparatus connected to the pressure control device adapter.

In some embodiments the ball drop apparatus comprises a housing having a remotely operable drop ball release device coupled to the housing, the remotely operable drop ball release device arranged to at least partially block the interior of the housing when in a deactivated state and when activated enables a drop ball to pass through the housing.

In some embodiments, the remotely operable drop ball release device comprises a fluid pressure actuated piston and a spring.

In some embodiments, the remotely operable latch on the night cap comprises a fluid pressure actuated piston arranged such that movement of the piston in a cylinder when fluid pressure is applied therein urges locking arms to pivot laterally inwardly so as to enable passage of the locking arms past a retaining feature in a night cap adapter.

DETAILED DESCRIPTION

Figure 1:
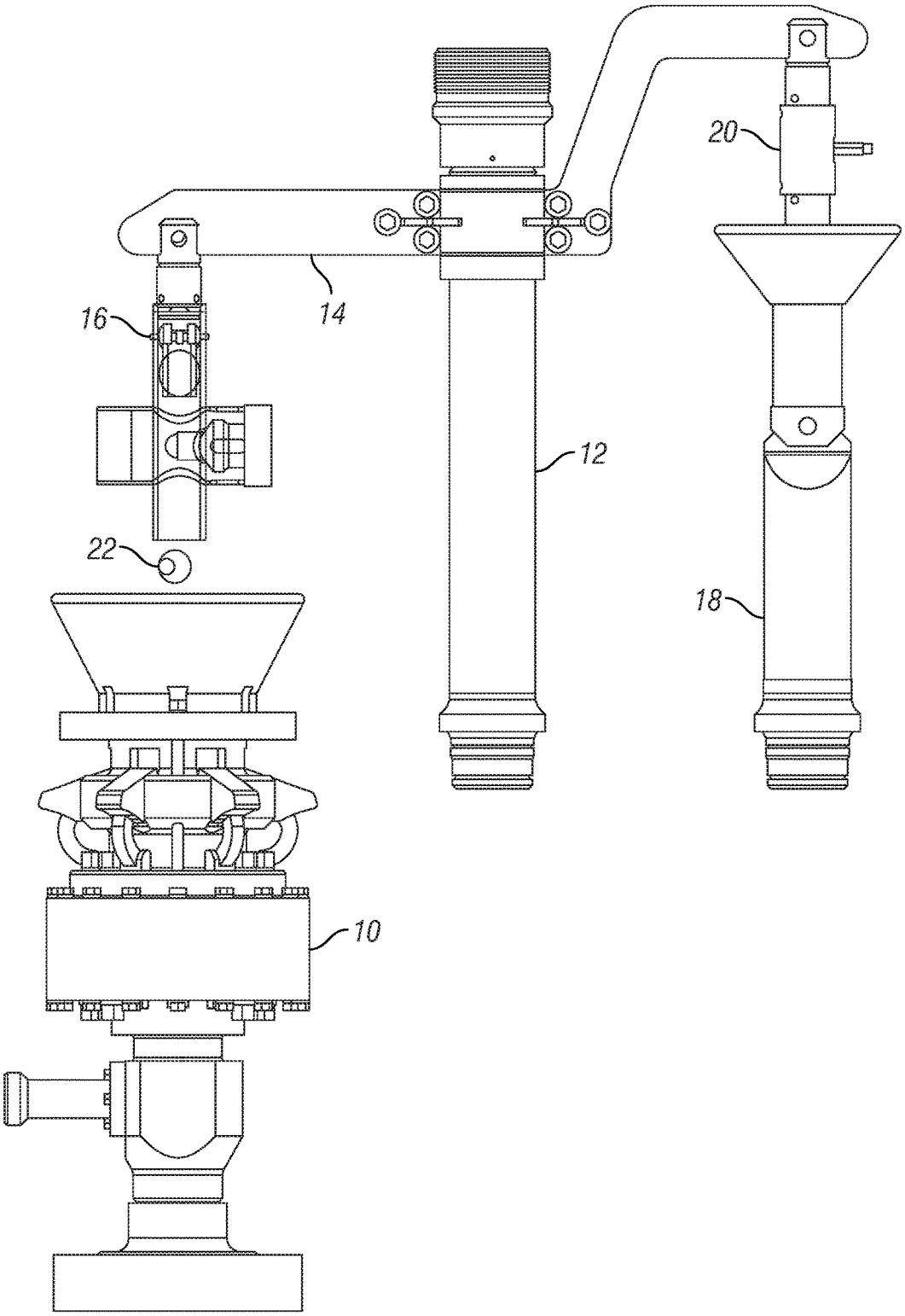
FIG. 1 shows a combination pressure control equipment adapter, night cap and ball drop apparatus wherein the ball drop apparatus is positioned over a pressure control apparatus.

U.S. Pat. Nos. 9,670,745 and 9,644,443 issued to Johansen et al., both of which are incorporated herein by reference in their entirety, disclose various embodiments of a wellhead pressure control apparatus. FIG. 1 shows in general form the pressure control apparatus 10 disclosed in the foregoing patents. An adapter 12 that may be locked in place in the pressure control apparatus 10 may be suspended by a crane (not shown) or similar hoisting device. The adapter 12 may also be substantially as described in the Johansen et al. patents referenced above.

A frame 14 may be coupled, such as by clamping, to the adapter 12. The frame 14 may extend laterally from the adapter 12 in both directions. One end of the frame 14 may be coupled to a ball drop apparatus 16. The ball drop apparatus 16 may be remotely operated, as will be explained in more detail with reference to FIGS. 9, 10 and 11, to drop a drop ball 22 into a wellbore (not shown) onto which the pressure control apparatus 10 is connected at a surface end of the wellbore. The drop ball 22 may be, for example, a fracture treatment stage closure ball, although the purpose for the drop ball 22 is not a limitation on the scope of the present disclosure.

The opposed end of the frame 14 may be coupled to a night cap 18, which may also be substantially as described in the Johansen et al. patents referenced above. The night cap 18 may be coupled to the frame 14 by a remotely operable latch 20. An example embodiment of the latch and its operation will be explained in more detail with reference to FIGS. 5, 5A and 6.

The present embodiment is described with reference to a pressure control adapter and a ball drop apparatus, however, it is to be understood that the scope of the present disclosure is not limited to such specific apparatus. Any other well intervention apparatus, i.e., a first well intervention apparatus and a second well intervention apparatus may be coupled to the frame 14 consistent with the scope of the present disclosure, In FIG. 1, the ball drop apparatus 16 is suspended over the pressure control apparatus to enable releasing the drop ball 22 into the wellbore (not shown).

Figure 2:
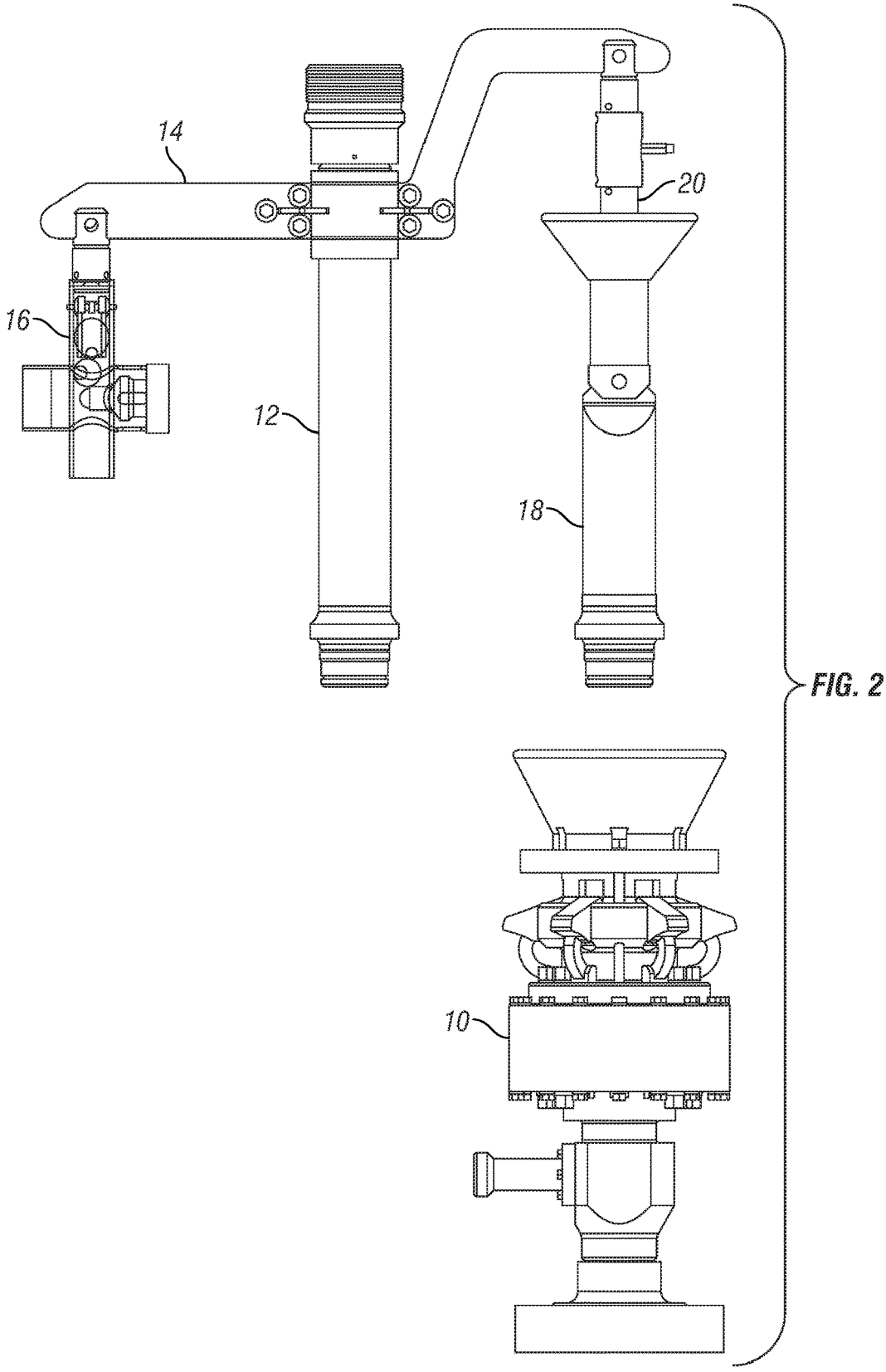
FIG. 2 shows the combination apparatus of FIG. 1 wherein the night cap is positioned over the pressure control apparatus.
Figure 3:
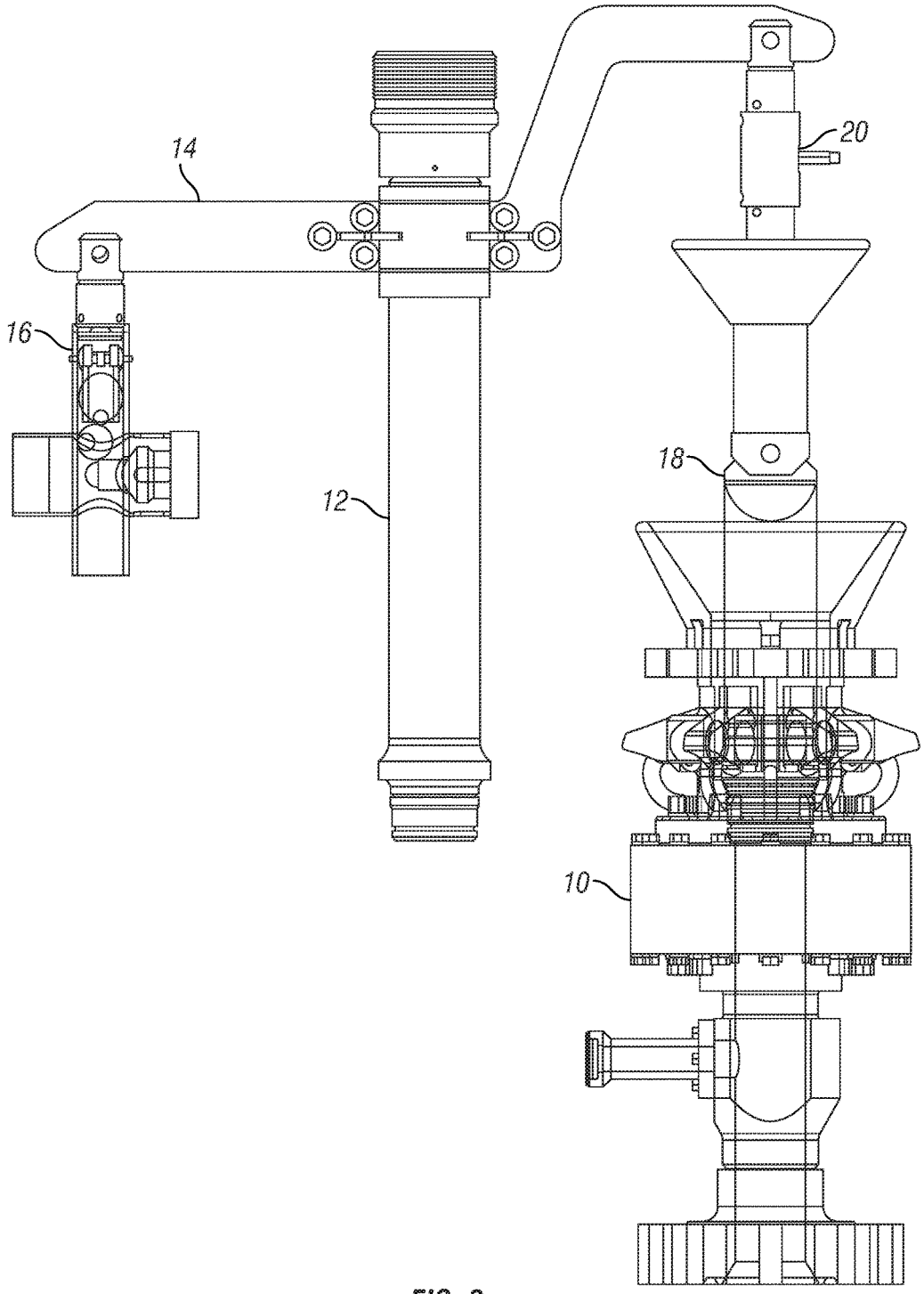
FIG. 3 shows the night cap being locked into the pressure control apparatus.

In FIG. 2, the night cap 18 is shown positioned over the pressure control apparatus 10 for eventual engagement and locking during temporary cessation of operations at the wellbore (not shown). FIG. 3 shows the night cap 18 inserted into and locked in place within the pressure control apparatus 10. Insertion and locking the night cap 18 in the pressure control apparatus 10 may be performed substantially as described in the Johansen et al. patents referenced above. If it is desired to lay down the adapter 12, frame 14 and ball drop apparatus 16 after locking the night cap 18 in the pressure control apparatus 10, the night cap 18 may be disengaged from the frame 14 by releasing the remotely operable latch 20. When operations at the wellbore resume, the remotely operable latch 20 may be reengaged with the night cap 18, the night cap 18 removed from the pressure control apparatus, and the adapter 12 may be inserted into the pressure control apparatus 10.

Figure 4:
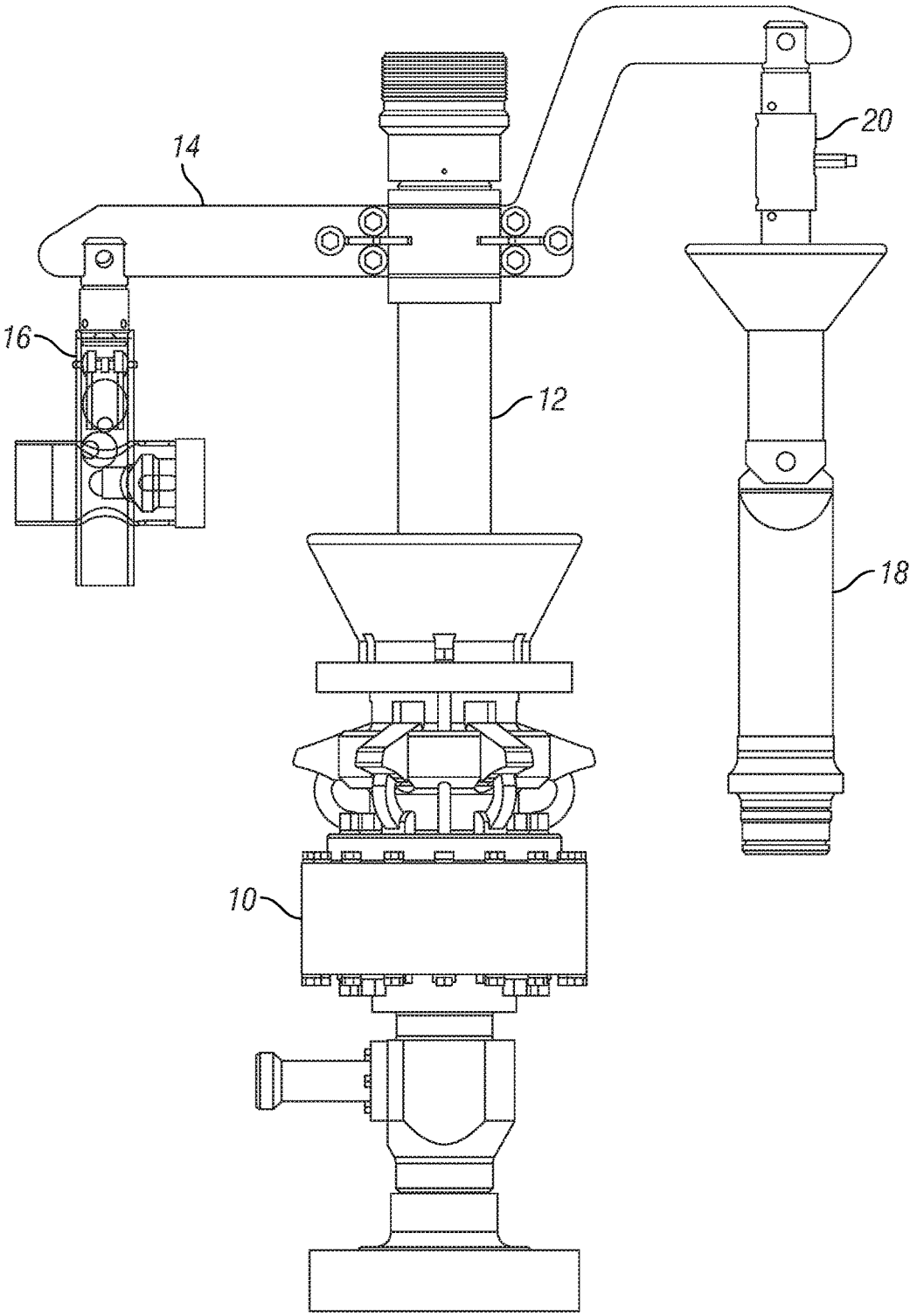
FIG. 4 shows the adapter locked in place in the pressure control apparatus.

FIG. 4 shows the adapter 12 locked in place within the pressure control apparatus 10.

Figure 5:
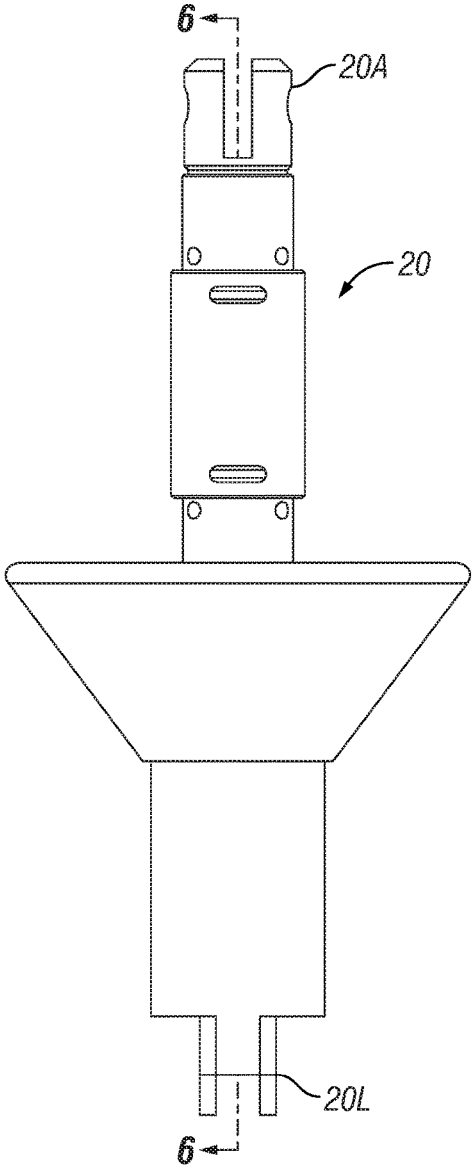
FIGS. 5, 5A and 6 show various views of a remotely operable latch to engage and disengage from the night cap.
Figure 6:
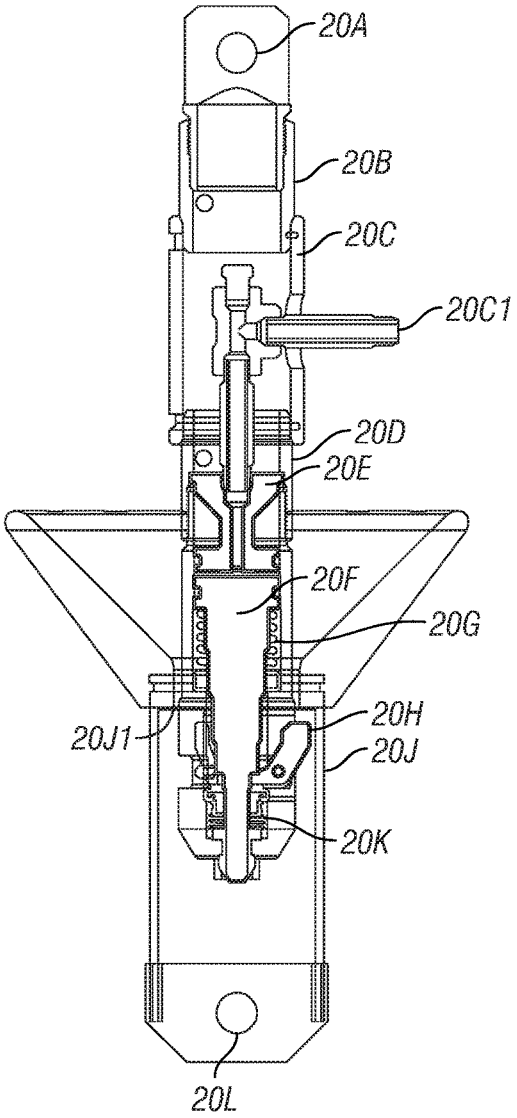
Figure 5A:
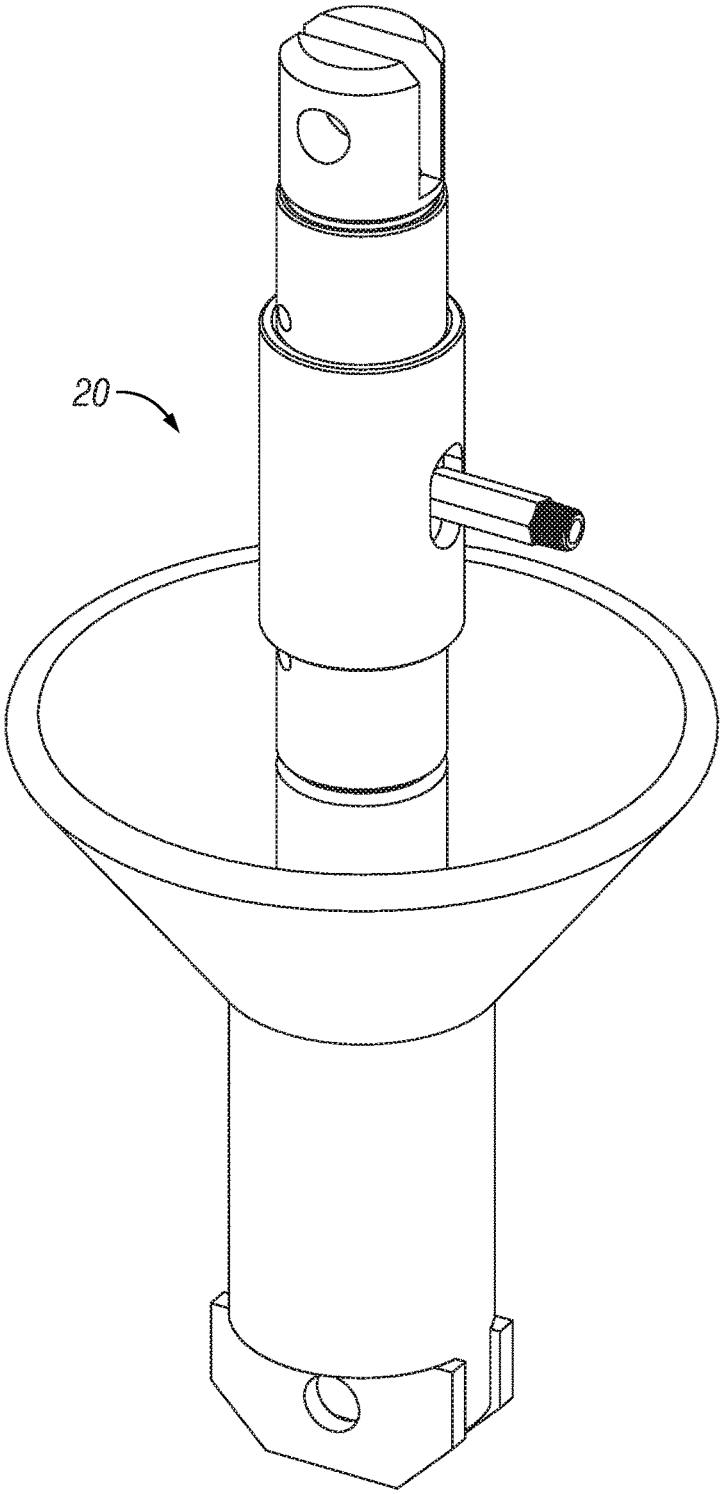

FIG. 5 shows a side view of one example embodiment of the remotely operable latch 20. A cross section shown in FIG. 6 is indicated by line 6-6' in FIG. 5. FIG. 6 shows the cross section of the present example embodiment of the remotely operable latch 20 indicated in FIG. 5. FIG. 5A shows a three dimensional oblique view of the remotely operable latch 20.

Referring to FIGS. 5 and 6, the remotely operable latch 20 may comprise an upper lift eye 20A to enable connection of the remotely operable latch to a hoisting device. In the present example embodiment, the upper lift eye 20A may be bolted, hooked, pinned or otherwise attached to the frame (14 in FIG. 1). The upper lift eye 20A may be coupled to a hydraulic connector and housing combination 20C by means of an upper swivel 20B. The hydraulic connector and housing combination 20C may be coupled to a lower swivel 20C.

The lower swivel 20C may comprise components to enable engaging the lower swivel 20C to an entry guide ("tulip") and night cap adapter 20J, and releasably locking the lower swivel 20C in place in the entry guide and night cap adapter 20J.

In the present example embodiment, the releasable locking features may comprise one or more locking arms 20H, which [is] are urged to pivot outwardly by a spring 20K. When the lower swivel 20C is inserted into the entry guide and night cap adapter 20J, the locking arms 20H may be laterally compressed into a receptacle in the lower portion of the entry guide and night cap adapter 20J. Such lateral compression causes the one or more locking arms 20H to compress the spring 20K. Once the one or more locking arms 20H move entirely within the receptacle in the lower portion of the entry guide and night cap adapter 20J, the one or more locking arms 20H are urged upwardly by the spring 20K and thus pivot outwardly to engage a locking surface 20J1 within the receptacle. Thus the lower swivel 20C is locked to the entry guide and night cap adapter 20J. A lower lift eye 20L may be pinned, bolted, or otherwise attached to a corresponding feature on the upper end of the night cap (18 in FIG. 1).

While the embodiment of remotely operable latch illustrated in FIGS. 5 and 6 is hydraulically actuated, those skilled in the art will readily recognize that other embodiments are possible. As one non limiting example, After the night cap is inserted into and locked in place in the pressure control apparatus as shown in FIG. 3, the remotely operable latch 20 may be operated to enable separation of the lower swivel 20C from the entry guide and night cap adapter 20J. In the present example embodiment, fluid pressure, for example hydraulic or pneumatic pressure may be introduced into the lower swivel 20C through an entry port 20C1. Fluid pressure may urge a release plunger 20F downwardly to engage the one or more locking arms 20H and urge them downwardly. Such downward urging causes the one or more locking arms 20H to pivot radially inwardly so as to enable them to pass through the locking surface 20J1. Thus, lifting the upper lift eye 20A will enable all the components described above to be removed from the entry guide and night cap adapter 20J. In the present example embodiment, a return spring 20G urges the release plunger 20G upwardly once fluid pressure is relieved, to enable the locking arms 20H once again to pivot outwardly, urged by the spring 20K.

By operating the remotely operable latch 20 as described above, the night cap 18 may be locked within the pressure control apparatus and all the other components as shown in FIG. 3 may be lifted away from the night cap and the pressure control apparatus to enable such other components to be moved away from the wellbore.

Figure 7:
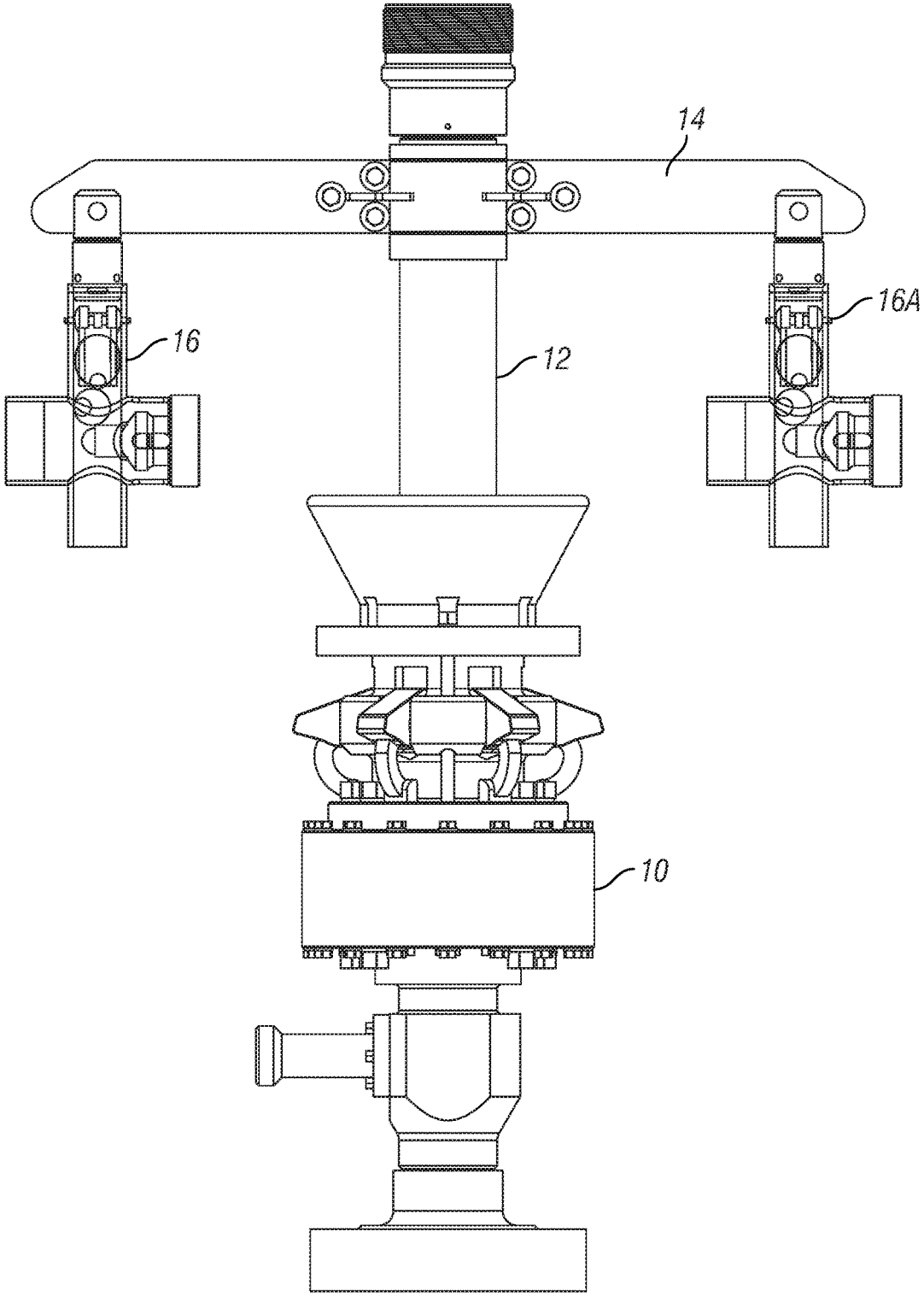
FIGS. 7 and 8 show another embodiment having two ball drop apparatus joined to a pressure control adapter.
Figure 8:
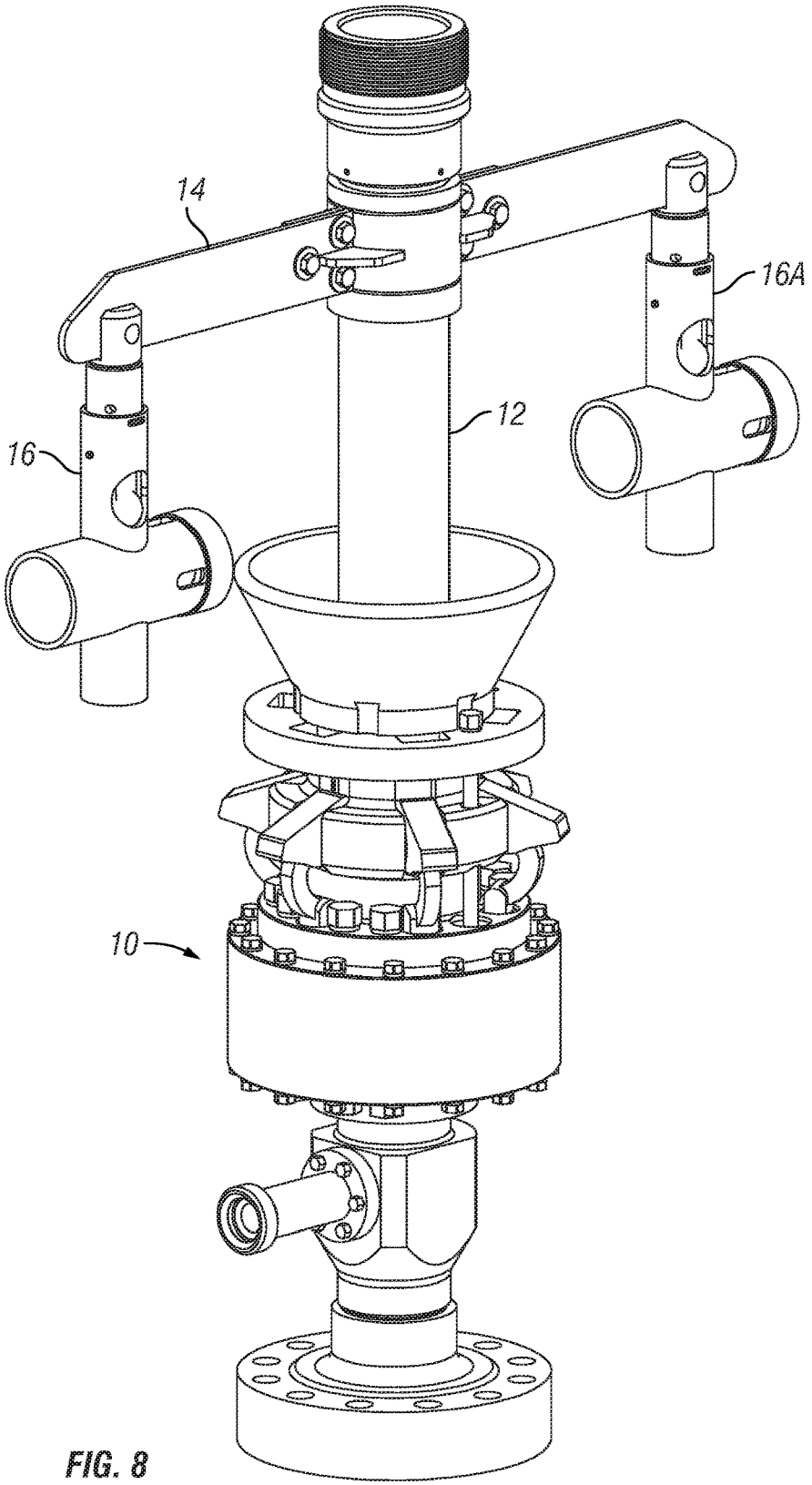

Referring to FIGS. 7 and 8, in some embodiments, a ball drop apparatus 16, 16A may be coupled to each lateral end of the frame 14; that is, the second ball drop apparatus 16A may substitute the night cap and releasable latch as shown in each of FIGS. 1, 2 and 3. The example embodiment shown in FIGS. 7 and 8 may be used where a particular wellbore operation requires more than one drop ball (see 22 in FIG. 1) to be placed in the wellbore (not shown in the drawings); or as a redundant measure in the event risk of failure of the ball drop apparatus 16 would make further operations on the wellbore (not shown) expensive or subject to other hazards.

Figure 9:
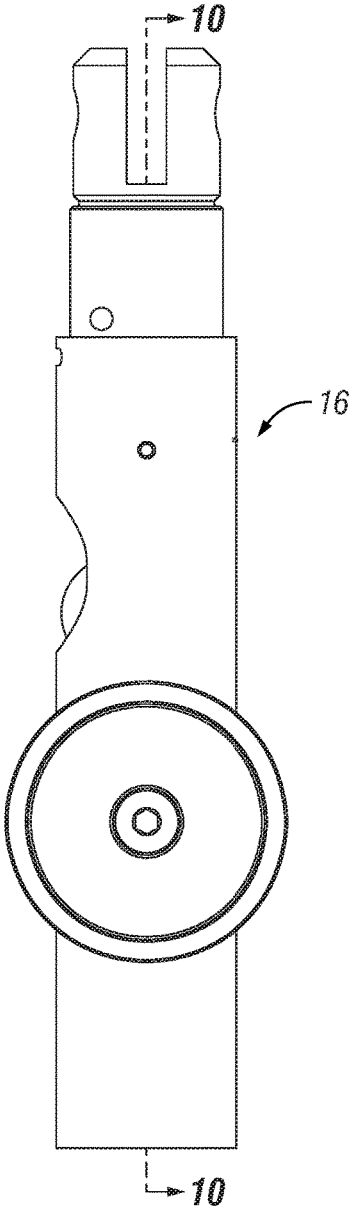
FIGS. 9, 10 and 11 show various views of an embodiment of a ball drop apparatus.
Figure 10:
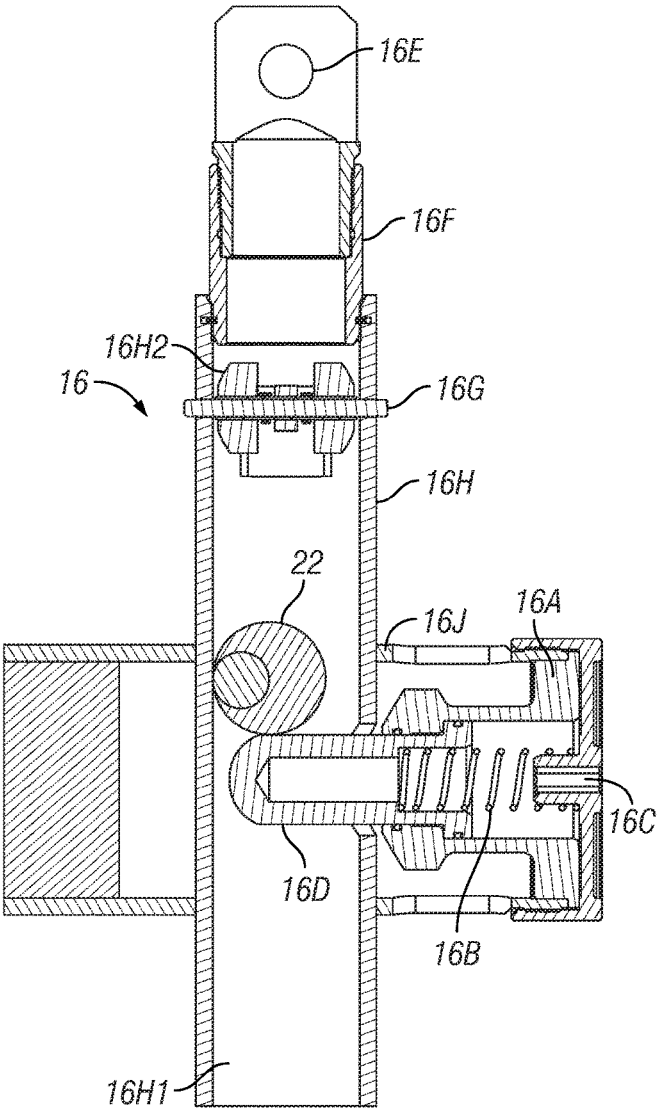
Figure 11:
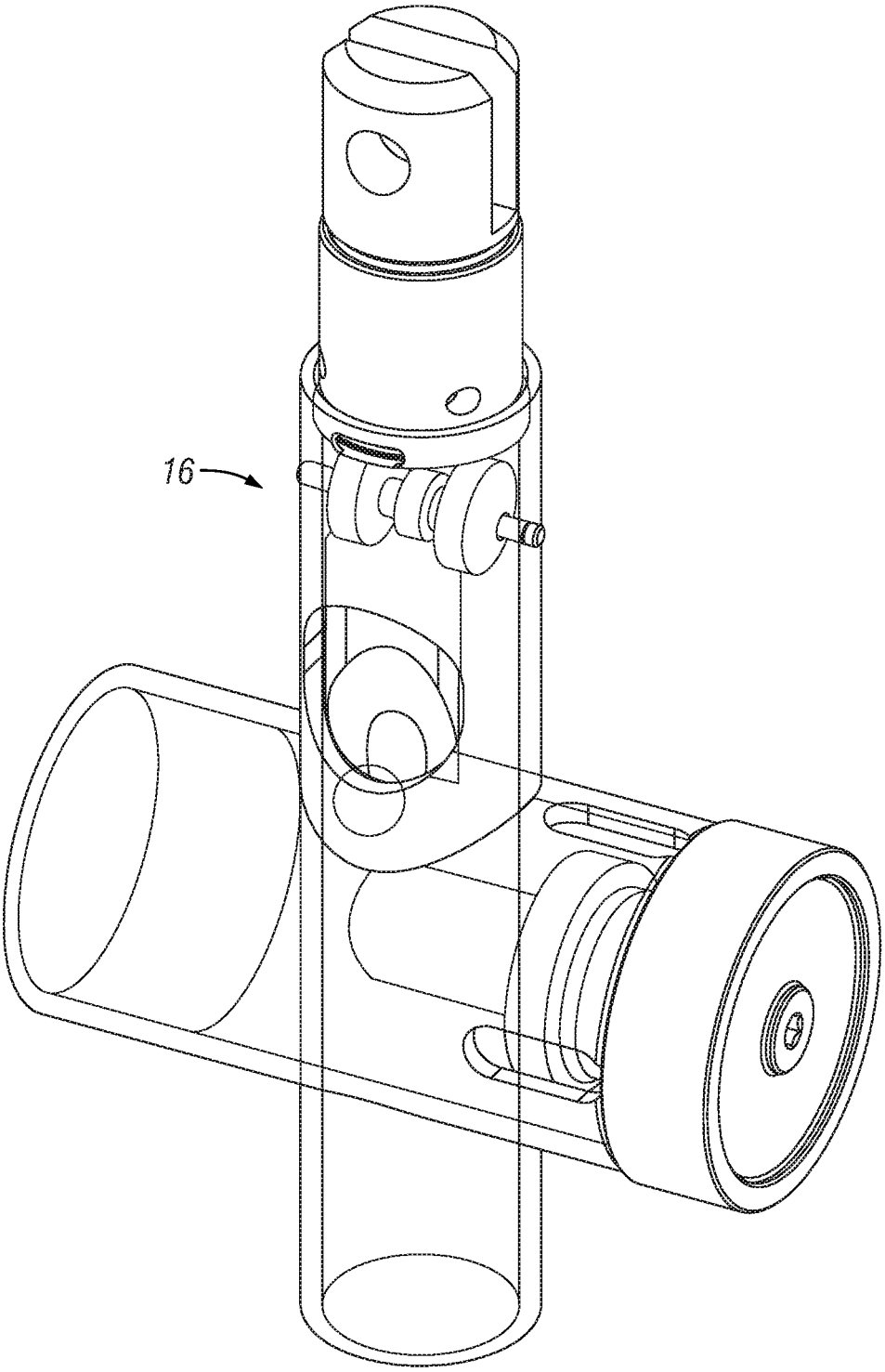

An example embodiment of the ball drop apparatus 16 is shown in more detail with reference to FIGS. 9, 10 and 11. FIG. 9 shows a side view and FIG. 10 shows a cross section along line 9-9' in FIG. 9 of the present example ball drop apparatus 16. With reference to FIG. 10, the ball drop apparatus 16 may comprise a generally T shaped housing 16H having an opening 16H2 at an upper end wherein may be inserted a lift eye adapter 16F having a lift eye 16E at its upper end for connection to the frame (14 in FIG. 1). The lift eye adapter 16F may be held in place by a removable fastener 16G such as a bolt, pin or similar device such that the lift eye adapter 16F may be removed to enable insertion of a drop ball 22. The lift eye adapter 16F may then be reattached by reversing the removal steps set forth above.

A ball drop apparatus according to the present disclosure comprises a remotely operable drop ball release device. The remotely operable drop ball release device may be arranged to at least partially block the interior of the housing 16H when in a deactivated state such that a drop ball 22 is retained in the housing 16H. When actuated, the drop ball release device may move to open the interior of the housing 16H at least enough to enable passage of the drop ball 22 through the housing.

In some embodiments the remotely operable drop ball release device may comprise a fluid pressure, e.g., an hydraulically or pneumatically operated device such as shown in FIG. 10. The fluid pressure operated drop ball release device may comprise a piston 16D disposed in a cylinder 16A. The cylinder 16A may be held in place through a side opening 16J in the housing 16H. The piston 16D may be, in the absence of fluid pressure urged toward the interior of the housing 16H by a spring 16B or other biasing device so as to retain the drop ball 22 within the housing 16H. A fluid port 16C may pass through the entire piston 16D such that on application of fluid pressure to the fluid port 16C, pressure acting on one side of the piston 16D causes the piston 16D to move outwardly against the force of the spring 16B. When the piston 16D has moved sufficiently, the interior of the housing 16H is opened to enable the drop ball 22 to fall through an opening 16H1 in the bottom of the housing 16H. When the drop ball apparatus 16 is positioned over the pressure control apparatus as shown in FIG. 1, the drop ball 22 may enter the wellbore (not shown) as explained with reference to FIG. 1.

While the present embodiment of a ball drop apparatus may use fluid pressure acting on a piston to cause the interior of the housing 16H to be opened to free movement of the drop ball 22, those skilled in the art will recognize that other embodiments may have different devices to enable selective opening of the housing 16H when it is desired to release the drop ball 22. As a non limiting example, an electrically operated solenoid may be in its unenergized state extended into the interior of the housing 16H so as to obstruct movement of the drop ball 22. When the solenoid is energized, it may retract in the direction of the side opening 16J so as to enable passage of the drop ball 22. Other selectively operable drop ball retention devices will occur to those skilled in the art.

A combination apparatus for use with a pressure control apparatus and methods as described herein may enable multiple different wellbore operations to be performed on a wellbore without the need to repeatedly lay down and pick up different types of wellbore intervention devices. Apparatus and methods according to the present disclosure may improve safety and reduce operating time and expense.

Although only a few examples have been described in detail above, those skilled in the art will readily appreciate that many modifications are possible in the examples. Accordingly, all such modifications are intended to be included within the scope of this disclosure as defined in the following claims.

What is claimed is:

1. A method for conducting intervention operations on a wellbore, comprising:

disposing a combination well intervention apparatus proximate a pressure control apparatus coupled to the wellbore, the combination apparatus comprising at least a pressure control device adapter lockable in the pressure control apparatus and at least one other type of well intervention device coupled to the pressure control device adapter by a frame coupled to and laterally extending from the pressure control device adapter such that the pressure control device adapter and the at least one other type of well intervention apparatus is each selectably disposable over the pressure control apparatus by laterally moving the frame;

moving the frame laterally in a first direction to suspend the pressure control device adapter over the pressure control apparatus and locking the pressure control device adapter in the pressure control apparatus by operating a remotely operable locking device on the pressure control apparatus; and moving the frame laterally in a different direction than the first direction so that the at least one other type of well intervention device is disposed over the pressure control apparatus.

2. The method of claim 1 further operating the at least one other type of well intervention device when disposed over the pressure control apparatus.

3. The method of claim 1 wherein the at least one other type of well intervention device comprises a remotely operable ball drop apparatus.

4. The method of claim 1 wherein the at least one other type of well intervention device comprises a pressure tight cap insertable into the pressure control apparatus.

5. The method of claim 1 further comprising at least two of another type of well intervention device coupled to the pressure control device adapter.

6. The method of claim 5 wherein the at least two of another type of well intervention device comprises one remotely operable ball drop apparatus and one pressure tight cap insertable into the pressure control apparatus.

7. The method of claim 5 wherein the at least two of another type of well intervention device comprises two remotely operable ball drop apparatus.

8. A device for use with a remotely operable pressure control apparatus, comprising:

a pressure control device adapter having features thereon for releasably locking the pressure control device adapter to the pressure control apparatus; and at least a first well intervention apparatus and a second well intervention apparatus connected to the pressure control device adapter by a frame laterally extending from the pressure control device adapter, from the at least a first well intervention apparatus and from the second well intervention apparatus such that only a selected one of the first well intervention apparatus, the second well intervention apparatus and the pressure control device adapter is movable over the pressure control apparatus by laterally moving the frame with reference to the pressure control apparatus.

9. The device of claim 8 wherein the first well intervention apparatus and the second well intervention apparatus each comprise one of a first remotely operable ball drop apparatus and a night cap having a remotely operable latch connected to the pressure control device adapter laterally spaced apart therefrom such that the pressure control device adapter and the at least one of a remotely operable ball drop apparatus and a night cap having a remotely operable latch are selectively movable over an upper opening in the pressure control apparatus.

10. The device of claim 9 further comprising a second remotely operable ball drop apparatus connected to the pressure control device adapter.

11. The device of claim 9 wherein the ball drop apparatus comprises a housing having a remotely operable drop ball release device coupled to the housing, the remotely operable drop ball release device arranged to at least partially block the interior of the housing when in a deactivated state and when activated enables a drop ball to pass through the housing.

12. The device of claim 11 wherein the remotely operable drop ball release device comprises a fluid pressure actuated piston and a spring.

13. The device of claim 9 wherein the remotely operable latch on the night cap comprises a fluid pressure actuated piston arranged such that movement of the piston in a cylinder when fluid pressure is applied therein urges locking arms to pivot laterally inwardly so as to enable passage of the locking arms past a locking surface in a night cap adapter.

* * * * *